US011776346B2

(12) United States Patent
Zhao et al.

(10) Patent No.: US 11,776,346 B2
(45) Date of Patent: Oct. 3, 2023

(54) SHEET-TYPE MEDIUM CONVEYING DEVICE AND CASH RECYCLING AND HANDLING APPARATUS

(71) Applicant: SHANDONG NEW BEIYANG INFORMATION TECHNOLOGY CO., LTD., Shandong (CN)

(72) Inventors: Zhenxing Zhao, Shandong (CN); Yong Yuan, Shandong (CN); Lei Zheng, Shandong (CN); Jianyu Sun, Shandong (CN); Qiangzi Cong, Shandong (CN)

(73) Assignee: SHANDONG NEW BEIYANG INFORMATION TECHNOLOGY CO., LTD., Shandong (CN)

( * ) Notice: Subject to any disclaimer, the term of this patent is extended or adjusted under 35 U.S.C. 154(b) by 528 days.

(21) Appl. No.: 16/978,007

(22) PCT Filed: Mar. 7, 2019

(86) PCT No.: PCT/CN2019/077332
§ 371 (c)(1),
(2) Date: Sep. 3, 2020

(87) PCT Pub. No.: WO2019/174519
PCT Pub. Date: Sep. 19, 2019

(65) Prior Publication Data

US 2020/0410804 A1 Dec. 31, 2020

(30) Foreign Application Priority Data

Mar. 13, 2018 (CN) ..... 201810205956.3

(51) Int. Cl.
*G07D 11/17* (2019.01)
*G07D 11/12* (2019.01)
*G07D 11/18* (2019.01)

(52) U.S. Cl.
CPC ..... *G07D 11/17* (2019.01); *G07D 11/12* (2019.01); *G07D 11/18* (2019.01);
(Continued)

(58) Field of Classification Search
CPC ..... G07D 11/18; G07D 11/12; G07D 11/16; G07D 11/009; G07D 11/17; G07D 11/14;
(Continued)

(56) References Cited

U.S. PATENT DOCUMENTS

2002/0074709 A1* 6/2002 Kanagawa ..... B65H 29/006 271/3.14
2004/0118910 A1* 6/2004 Gallo-Hendrikx .... G07F 19/205 235/379
(Continued)

FOREIGN PATENT DOCUMENTS

CN 102044107 A 5/2011
CN 103426229 A 12/2013
(Continued)

OTHER PUBLICATIONS

Indian Office Action issued by the Intellectual Property India in connection with International Patent Application No. 2020/27038087 dated Sep. 17, 2021.
(Continued)

*Primary Examiner* — Jeffrey A Shapiro
(74) *Attorney, Agent, or Firm* — Carter, DeLuca & Farrell LLP; George Likourezos

(57) ABSTRACT

Disclosed are a sheet-type medium conveying device and a cash recycling and handling apparatus. The sheet-type medium conveying device includes a first passage plate, a second passage plate and a driving mechanism. The first passage plate and the second passage plate are oppositely arranged. A passage is formed between the first passage plate and the second passage plate, and configured for a sheet-type
(Continued)

medium to pass through. The driving mechanism is configured to drive a first end of the first passage plate and a first end of the second passage plate to get close to or away from each other.

19 Claims, 5 Drawing Sheets

(52) U.S. Cl.
CPC ..... *B65H 2301/3124* (2013.01); *B65H 2301/3311* (2013.01); *B65H 2301/3611* (2013.01); *B65H 2404/611* (2013.01)

(58) Field of Classification Search
CPC ..... B65H 29/58; B65H 2404/623; B65H 2404/611; B65H 2404/61; B65H 2301/36212; B65H 2301/36112; B65H 2301/3311; B65H 2301/324; B65H 2301/3124; B65H 2301/312; B65H 2301/3611; B65H 2301/4314; B65H 2701/1912
USPC ..... 194/344; 453/50–52
See application file for complete search history.

(56) References Cited

U.S. PATENT DOCUMENTS

2007/0257426 A1* 11/2007 DeGruchy ..... B65H 29/58 271/303
2009/0212493 A1* 8/2009 Sugahara ..... G07D 11/40 271/272
2010/0194033 A1* 8/2010 Berendes ..... B65H 29/60 271/239
2011/0114441 A1 5/2011 Seki et al.
2015/0093229 A1* 4/2015 Hirano ..... B65H 29/001 414/788.1
2018/0040187 A1* 2/2018 Jeong ..... G07D 11/125
2018/0267450 A1* 9/2018 Kosuge ..... G03G 15/6573
2020/0087100 A1* 3/2020 Fukasawa ..... B65H 29/58

FOREIGN PATENT DOCUMENTS

CN 103449231 A 12/2013
CN 203870711 U 10/2014
CN 105160760 A 12/2015
CN 204883919 U 12/2015
CN 105447962 A 3/2016
CN 106695795 A 5/2017
CN 206224707 U 6/2017
CN 107610327 A 1/2018
JP 2010055337 A 3/2010
JP 2012141673 A 7/2012
WO 2015032184 A1 3/2015

OTHER PUBLICATIONS

Chinese Office Action issued by the State Intellectual Propoerty Office of People's Republic of China related to International Application No. 201810205956.3 dated Dec. 21, 2020.
International Search Report issued by the State Intellectual Property Office of the P.R. China in connection with International Application No. PCT/CN2019/077332 dated May 29, 2019.

* cited by examiner

SHEET-TYPE MEDIUM CONVEYING DEVICE AND CASH RECYCLING AND HANDLING APPARATUS

This application claims priority to Chinese Patent Application No. 201810205956.3 filed with CNIPA on Mar. 13, 2018, disclosure of which is incorporated herein by reference in its entirety.

TECHNICAL FIELD

The present disclosure relates to the technical field of financial self-service apparatus, for example, a sheet-type medium conveying device and a cash recycling and handling apparatus.

BACKGROUND

A cash recycling and handing apparatus is a kind of financial self-service apparatus which combines a plurality of functions of banknote recycling, depositing, withdrawing, temporary storage, clearing, counting, identification, serial number recording, continuous and uninterrupted banknote input, daily banknote keeping, inquiry, etc. In addition, the cash recycling and handing apparatus is capable of recycling at least one denomination of banknotes in circulation.

A basic operation process of the cash recycling and handing apparatus is described as follows. In a banknote inputting process, the banknotes are entered from an input device; after being identified by a banknote identification device, banknotes that meet requirements are conveyed by a public conveying passage and stored in at least one cash box of a safe. In a banknote outputting process, banknotes are entered into the public conveying passage from the cash box, and conveyed to the banknote identification device through the public conveying passage; after being identified by the banknote identification device, banknotes that meet requirements are output to an output device, and banknotes that do not meet requirements are conveyed to a recycling box. However, when the cash recycling and handing apparatus in the related art is in operation, there is a problem of difficulty in banknote inputting and outputting during the banknote inputting process of banknote entering into the cash box through the public conveying passage and the banknote outputting process of banknote entering into the public conveying passage through the cash box. In addition, in a process of pulling out the cash box from the safe, there may be cases of damaging the banknotes such as tearing the banknotes.

SUMMARY

The present disclosure provides a sheet-type medium conveying device, which is suitable for bidirectional conveying of a sheet-type media such as banknotes, paper, checks, cards, etc., to solve the problem of difficulty in banknote inputting and outputting in a working process of related cash recycling and handling apparatus.

The present disclosure further provides a cash recycling and handling apparatus, to solve the problem of difficulty in banknote inputting and outputting in a working process of related cash recycling and handling apparatus.

In an embodiment, a sheet-type medium conveying device provided in the present disclosure includes a first passage plate, a second passage plate and a driving mechanism. The first passage plate and the second passage plate are oppositely arranged. A passage is formed between the first passage plate and the second passage plate, and configured for a sheet-type medium to pass through. The driving mechanism is configured to drive a first end of the first passage plate and a first end of the second passage plate to get close to or away from each other.

In an embodiment, a cash recycling and handling apparatus provided in the present disclosure includes an upper device and a lower device. A public conveying passage is arranged in the upper device. The lower device includes a safe and a plurality of cash boxes located in the safe. A branch passage is correspondingly provided between the public conveying passage and each of the plurality of cash boxes, and at least one of the plurality of branch passages between the public conveying passage and the plurality of cash boxes is the sheet-type medium conveying device of the above embodiment.

Figure 1:
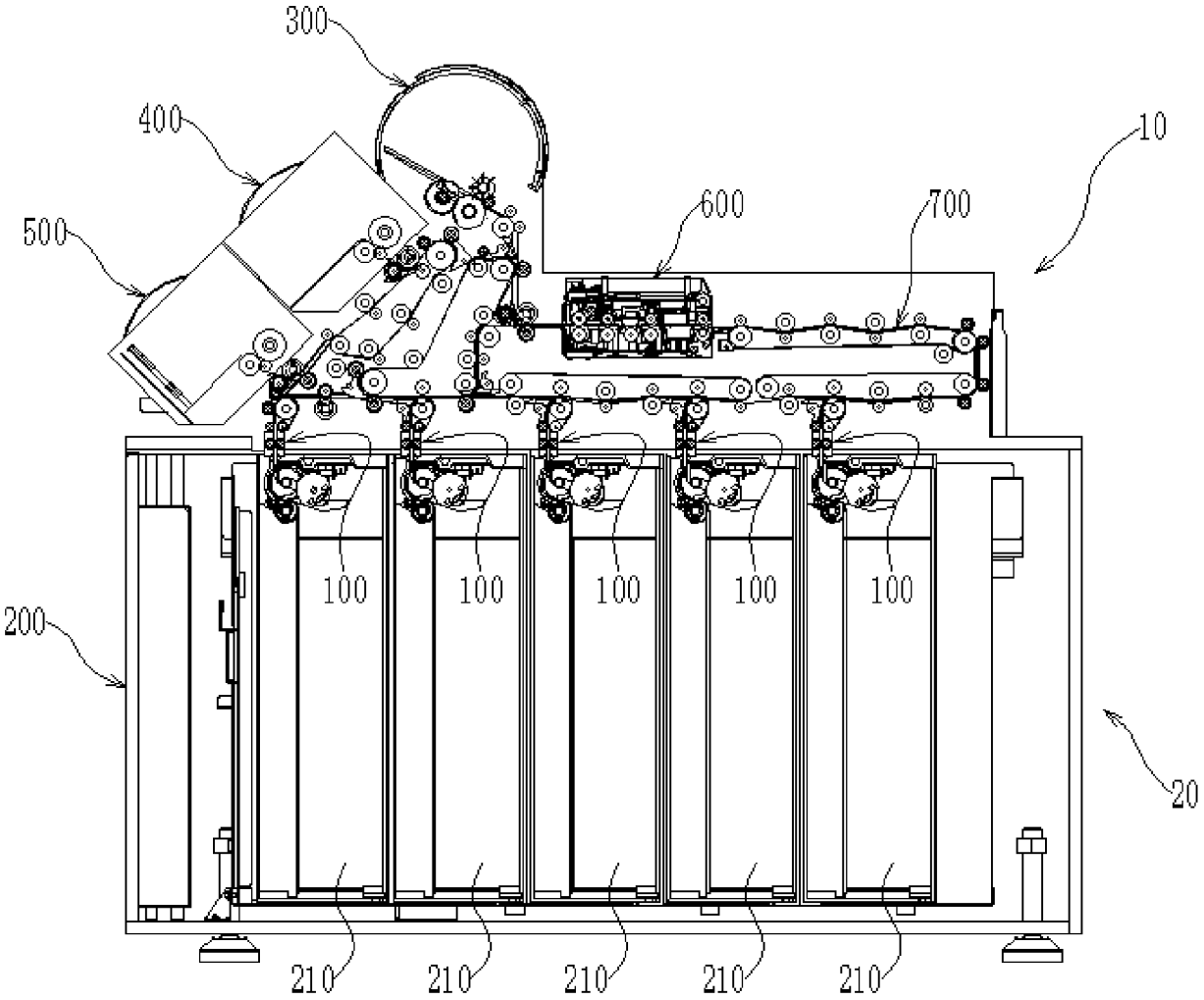
FIG. 1 is a structural schematic view of a cash recycling and handling apparatus according to an embodiment of the present disclosure.

Referring list: 10—upper device; 20—lower device; 30—driving mechanism; 40—passage; 100—sheet-type medium conveying device; 200—safe; 300—input device; 400—output device; 500—temporary storage device; 600—banknote identification device; 700—public conveying passage; 110—mounting frame; 120—first passage plate; 130—second passage plate; 140—first gear; 150—second gear; 160—transmission wheel; 170—torque limiter; 180—detection assembly; 111—first limiting plate; 112—second limiting plate; 113—limiting member; 117—motor; 118—motor gear; 121—first slot; 122—first limiting portion; 123—first rotating shaft; 124—first end; 125—second end; 131—second slot; 132—second limiting portion; 133—second rotating shaft; 134—first end; 135—second end; 181—signal transmitter; 182—signal receiver; 210—cash box.

DETAILED DESCRIPTION

The described embodiments herein are part, not all, of embodiments of the present disclosure. In the description of the present disclosure, it should be understood that the orientational or positional relationships indicated by terms "above", "below", "inside" and the like are based on the orientational or positional relationships illustrated in the drawings, which are for the mere purpose of facilitating and simplifying the description of the present disclosure, and these relationships do not indicate or imply that the device or element referred to has a specific orientation and is constructed and operated in a specific orientation, and thus it is not to be construed as limiting the present disclosure. In addition, terms such as "first" and "second" are used merely for the purpose of description and are not to be construed as indicating or implying relative importance.

In the description of the present disclosure, unless otherwise expressly specified and limited, the term "mount" is to be construed in a broad sense, for example, may be construed as a fixed connection, a detachable connection, or an integral connection; a direct connection or an indirect connection through an intermediate medium; or a connection between interiors of two elements. For those of ordinary skill in the art, specific meanings of the preceding terms in the present disclosure may be understood based on specific situations.

As shown in FIG. 1, a cash recycling and handling apparatus provided in the present embodiment includes an upper device 10, a lower device 20, and at least one sheet-type medium conveying device 100. In an embodiment, a public conveying passage 700 is arranged in the upper device 10. The lower device 20 includes a safe 200 and a plurality of cash boxes 210 located in the safe 200. A branch passage is correspondingly provided between the public conveying passage 700 and each of the plurality of cash boxes 210, and at least one of branch passages adopts the sheet-type medium conveying device 100 provided by the present embodiment. In the present embodiment, five cash boxes 210 are provided in the safe 200, and all of the branch passages between the five cash boxes 210 and the public conveying passage 700 adopt the sheet-type medium conveying device 100 provided in the present embodiment.

Figure 2:
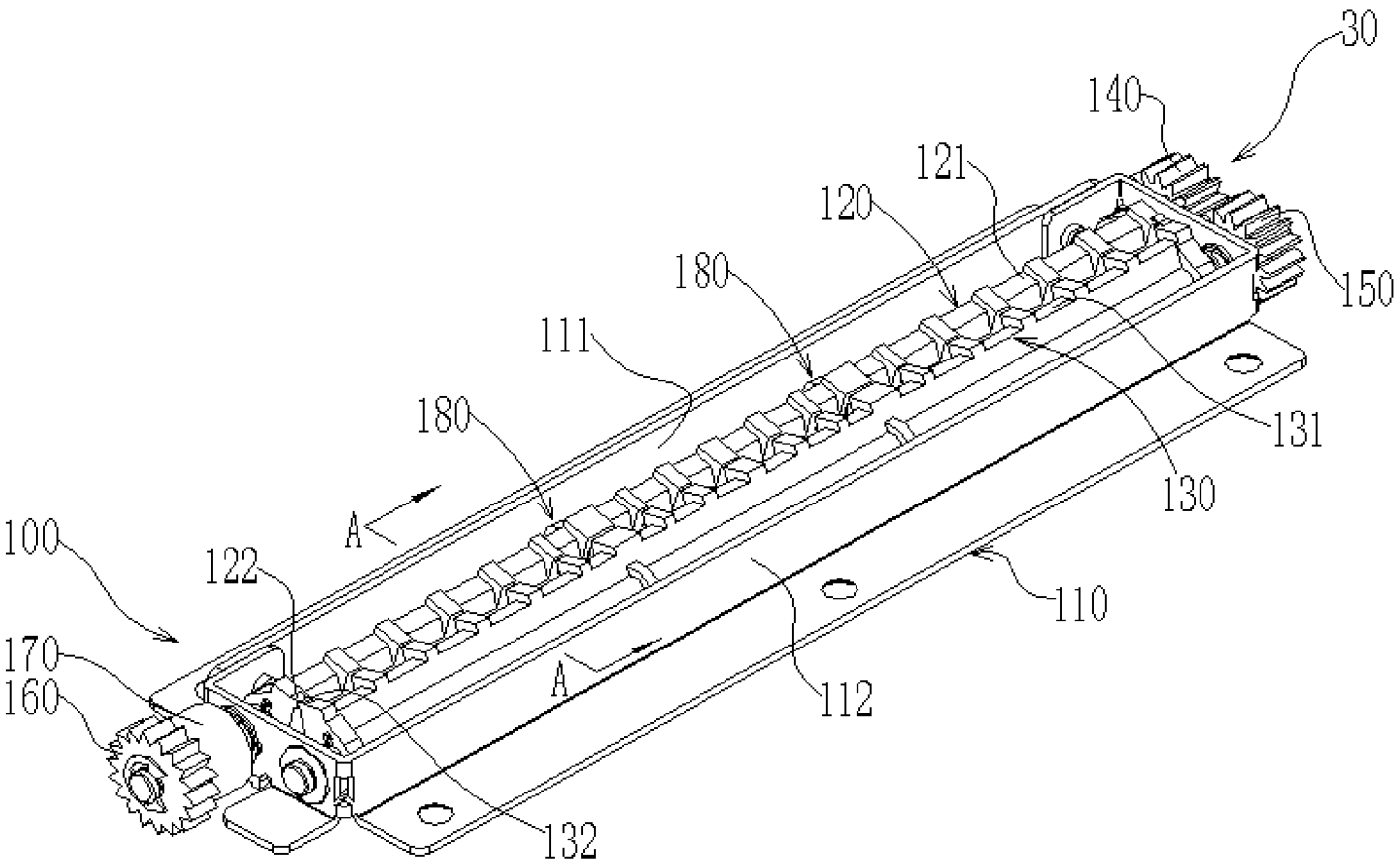
FIG. 2 is a structural schematic view of a sheet-type medium conveying device according to an embodiment of the present disclosure.
Figure 3:
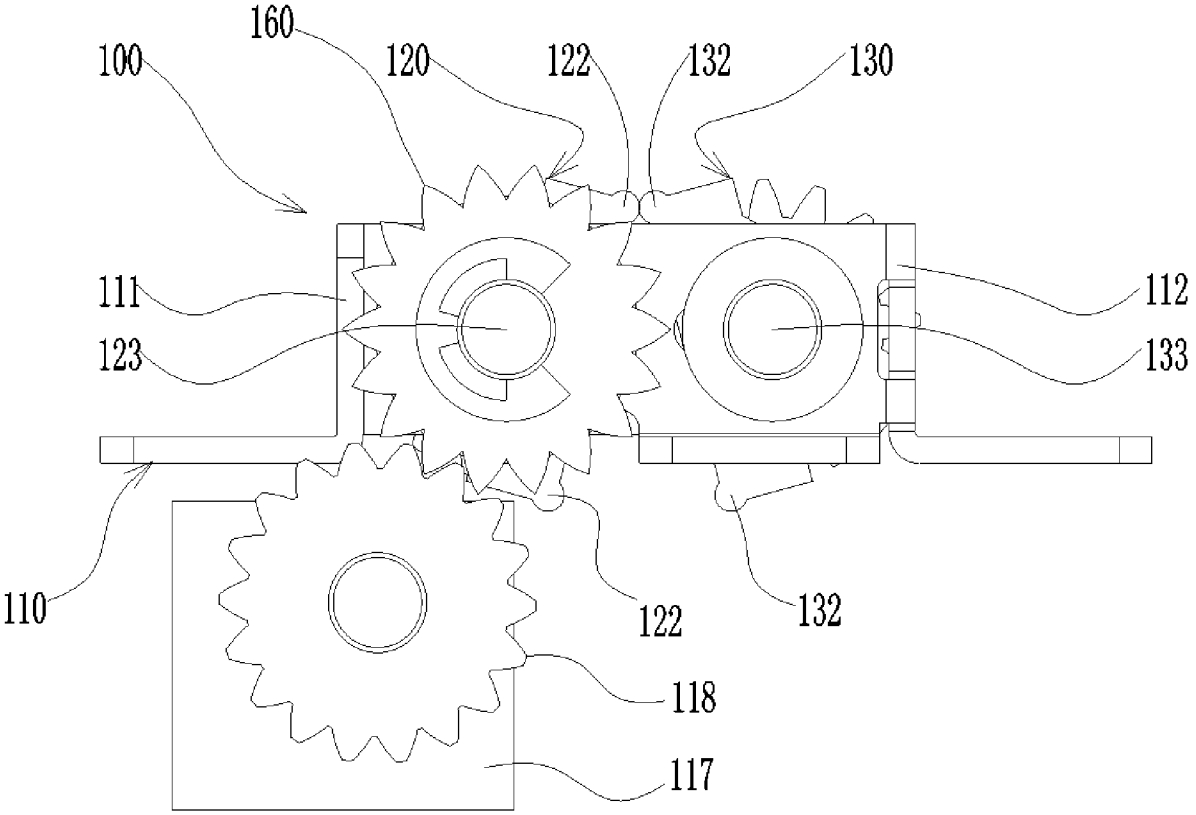
FIG. 3 is a structural front view of a sheet-type medium conveying device according to an embodiment of the present disclosure.
Figure 4:
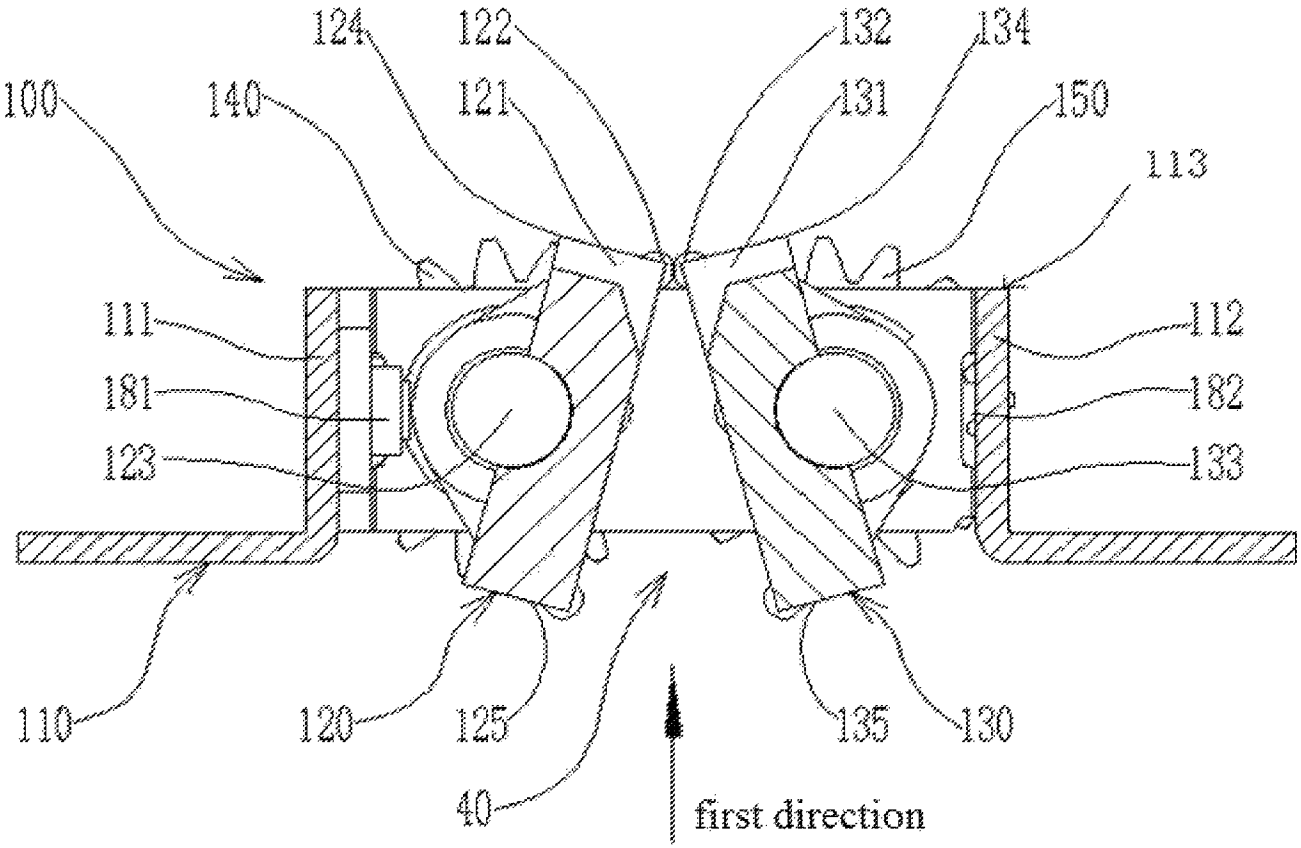
FIG. 4 is a structural schematic view of the sheet-type medium conveying device under an A-A section of FIG. 2 according to an embodiment of the present disclosure.

As shown in FIG. 2 to FIG. 4, the present embodiment provides a sheet-type medium conveying device 100. In an embodiment, the sheet-type medium conveying device 100 includes a first passage plate 120, a second passage plate 130, and a driving mechanism 30; where the first passage plate 120 and the second passage plate 130 are oppositely disposed, and a passage 40 is formed between the first passage plate 120 and the second passage plate 130 and configured for the sheet-type medium to pass through. Along a moving direction of the sheet-type medium, the first passage plate 120 includes a first end 124 and a second end 125, and the second passage plate 130 includes a first end 134 and a second end 135. The driving mechanism 30 is configured to drive the first end 124 of the first passage plate 120 and the first end 134 of the second passage plate 130 to get close to or away from each other.

Figure 5:
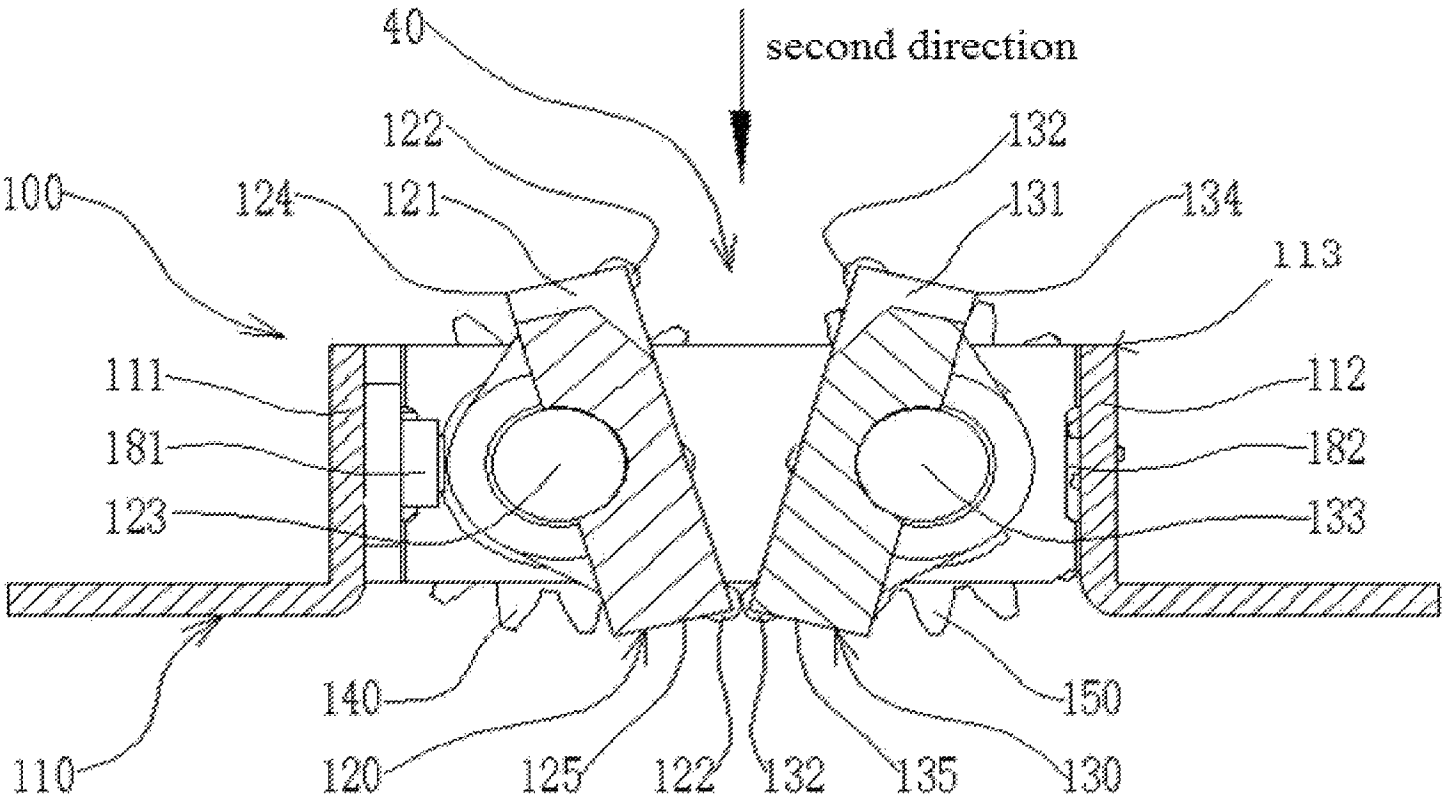
FIG. 5 is a structural schematic view of another sheet-type medium conveying device under the A-A section of FIG. 2 according to an embodiment of the present disclosure.

A process of the sheet-type medium conveying device 100 guiding the sheet-type medium is described as follows. As shown in FIG. 4, when the sheet-type medium moves in a first direction, the driving mechanism 30 drives the first end 124 of the first passage plate 120 and the first end 134 of the second passage plate 130 to get close to each other. At this moment, a narrow opening is formed between the first end 124 of the first passage plate 120 and the first end 134 of the second passage plate 130, while a wide opening is formed between the second end 125 of the first passage plate 120 and the second end 135 of the second passage plate 130, and the sheet-type medium conveying device 100 is in a first state. The sheet-type medium enters from the wide opening, moves in the passage 40 formed between the first passage plate 120 and the second passage plate 130, and is output through the narrow opening. As shown in FIG. 5, when the sheet-type medium moves in a second direction opposite to the first direction, the driving mechanism 30 drives the first end 124 of the first passage plate 120 and the first end 134 of the second passage plate 130 to get away from each other. At this moment, a wide opening is formed between the first end 124 of the first passage plate 120 and the first end 134 of the second passage plate 130, and a narrow opening is formed between the second end 125 of the first passage plate 120 and the second end 135 of the second passage plate 130, and the sheet-type medium conveying device 100 is in a second state. The sheet-type medium still enters the passage 40 through the wide opening and is output through the narrow opening.

In the present embodiment, the sheet-type medium may be banknotes

A process of the sheet-type medium conveying device 100 guiding banknotes is described as follows. In a banknote inputting process, that is, when the banknotes move in the second direction, the sheet-type medium conveying device 100 is in the second state under action of the driving mechanism 30, that is, the first passage plate 120 and the second passage plate 130 move relatively such that the wide opening is formed at the upper end of the first passage plate 120 and the upper end of the second passage plate 130 and the narrow opening is formed at the lower end of the first passage plate 120 and the lower end of the second passage plate 130 (as shown in FIG. 5). At this moment, the banknotes conveyed through the public conveying passage 700 enter from the wide opening at the upper end of the first passage plate 120 and the upper end of the second passage plate 130, and are output from the narrow opening at the lower end of the first passage plate 120 and the lower end of the second passage plate 130 to the cash box 210 to complete the banknote inputting. In a banknote outputting process, that is, when the banknotes move in the first direction, the sheet-type medium conveying device 100 is in the first state under the action of the driving mechanism 30, that is, the first passage plate 120 and the second passage plate 130 move relatively such that the narrow opening is formed at the upper end of the first passage plate 120 and the upper end of the second passage plate 130 and the wide opening is formed at the lower end of the first passage plate 120 and the lower end of the second passage plate 130 (as shown in FIG. 4). At this moment, the banknotes in the cash box 210 enter from the wide opening at the lower end of the first passage plate 120 and the lower end of the second passage plate 130, and are output from the narrow opening at the upper end of the first passage plate 120 and the upper end of the second passage plate 130 to the public conveying passage 700 to complete the banknote outputting.

The sheet-type medium conveying device 100 uses the wide opening between the first passage plate 120 and the second passage plate 130 to realize the expand of an entrance of the passage 40, so that banknotes can smoothly enter into the passage 40 from the public conveying passage 700 and into the passage 40 from the cash box 210. At the same time, the sheet-type medium conveying device 100 uses the narrow opening between the first passage plate 120 and the second passage plate 130 to guide the banknotes. Through docking of the narrow opening with a target passage, it is ensured that the banknotes in the passage 40 can be reliably guided into the cash box 210 or the public conveying passage 700, thereby ensuring smooth banknotes inputting and outputting, and well improving the disadvantage of the difficulty in banknotes inputting and outputting in the related art. In addition, the sheet-type medium conveying device 100 is simple in structure and easy in implementation, which is of great significance for guidance and conveying of banknotes in financial self-service apparatus.

In the present embodiment, the "first state" refers to the state when the first end 124 of the first passage plate 120 and the first end 134 of the second passage plate 130 get close to each other; and the "second state" refers to the state when the first end 124 of the first passage plate 120 and the first end 134 of the second passage plate 130 get away from each other.

With continuous reference to FIG. 2 and FIG. 3, in the present embodiment, the sheet-type medium conveying device 100 may further include a mounting frame 110. The first passage plate 120 and the second passage plate 130 are both pivotally connected to the mounting frame 110. In an embodiment, a middle portion of the first passage plate 120 and a middle portion of the second passage plate 130 are both pivotally connected to the mounting frame 110. The banknotes are allowed to move bidirectionally in the passage 40. When the banknotes move in the first direction in the passage 40, the driving mechanism 30 is configured to drive the first passage plate 120 and the second passage plate 130 to rotate, so that the first end 124 of the first passage plate 120 and the first end 134 of the second passage plate 130 get close to each other while the second end 125 of the first passage plate 120 and the second end 135 of the second passage plate 130 get away from each other. In an embodiment, along the first direction, the first end 124 of the first passage plate 120 is located upstream of the second end 125 of the first passage plate 120, and the first end 134 of the second passage plate 130 is located upstream of the second end 135 of the second passage plate 130.

In the banknote inputting process, as shown in FIG. 5, the first passage plate 120 and the second passage plate 130 are disposed in an inverted flared shape; while in the banknote outputting process, as shown in FIG. 4, the first passage plate 120 and the second passage plate 130 are in a flared shape. In the present embodiment, the first passage plate 120 is pivotally connected to the mounting frame 110 via a first rotating shaft 123, and the second passage plate 130 is pivotally connected to the mounting frame 110 via a second rotating shaft 133. The arrangement of the mounting frame 110 enables the sheet-type medium conveying device 100 to be reliably mounted in the cash recycling and handling apparatus, and realizes modularization of the sheet-type medium conveying device 100 of the present embodiment. In addition, in later maintenance, the mounting frame 110 can be removed from the safe 200 to realize overall disassembly of the sheet-type medium conveying device 100, thereby greatly improving convenience of maintenance.

With continuous reference to FIG. 2 to FIG. 5, in the present embodiment, the driving mechanism 30 may include a motor 117, a first gear 140, and a second gear 150. The first gear 140 is fixedly sleeved onto the first rotating shaft 123, and the second gear 150 is fixedly sleeved onto the second rotating shaft 133. The first gear 140 and the second gear 150 mesh with each other, and the motor 117 is in transmission connection to the first gear 140 or the second gear 150. In the present embodiment, the motor 117 outputs power to the first gear 140 so as to drive the first gear 140 to rotate, and the first gear 140 drives the second gear 150 to rotate so as to realize the first passage plate 120 and the second passage plate 130 rotate synchronously in opposite directions.

The sheet-type medium conveying device 100 utilizes gear meshing transmission, which not only realizes synchronous movement of the first passage plate 120 and the second passage plate 130, but also enables a rotating direction of the first passage plate 120 and a rotating direction of the second passage plate 130 to always keep opposite, so as to ensure that, while the first end 124 of the first passage plate 120 and the first end 134 of the second passage plate 130 get close to each other, the second end 125 of the first passage plate 120 and the second end 135 of the second passage plate 130 get away from each other, thereby ensuring smooth running of banknote inputting and outputting. In addition, such arrangement also realizes one motor 117 simultaneous driving two passage plates to move, which not only greatly reduces manufacturing cost, but also saves layout space and has a high degree of integration.

With continuous reference to FIG. 2 to FIG. 5, in the present embodiment, numbers of modulus and teeth of the first gear 140 and the second gear 150 are the same. With such arrangement, during the meshing transmission of the first gear 140 and the second gear 150, the first passage plate 120 and the second passage plate 130 rotate at a same angle, so that the passage 40 always maintains a symmetrical state, thereby enabling banknotes to pass through from a middle of the passage 40, which further ensures reliability of banknote inputting and outputting.

In the present embodiment, as shown in FIG. 2 and FIG. 3, a transmission wheel 160 is fixedly sleeved onto one end of the first rotating shaft 123 located facing away from the first gear 140, and a motor gear 118 of the motor 117 is in transmission connection to the transmission wheel 160, thereby driving the first gear 140 to rotate, so as to drive the second gear 150 to rotate, so that the first passage plate 120 and the second passage plate 130 rotate synchronously in opposite directions.

In the present embodiment, the power of the motor 117 may be, but not limited to, input to the first gear 140 to drive the second gear 150 to rotate, other arrangements may also be adopted, for example, the power of the motor 117 may be input to the second gear 150 to drive the first gear 140 to rotate, that is, as long as relative movement of the first passage plate 120 and the second passage plate 130 can be achieved through this kind of power input.

In an embodiment, the first gear 140 and the second gear 150 may be, but not limited to, cylindrical gears as shown in the figure, and other arrangements, such as sector gears, may also be adopted. Such arrangement not only reduces weight of the first gear 140 and the second gear 150, thereby reducing overall weight of the sheet-type medium conveying device 100 of the present embodiment, but also, the arrangement of the sector gears, saves gear manufacturing materials and reduces gear manufacturing costs.

In the present embodiment, a torque limiter 170 may also be disposed between the motor 117 and the first gear 140. In an embodiment, the torque limiter 170 is disposed between the transmission wheel 160 and the first rotating shaft 123. The driving end of the torque limiter 170 is fixedly connected to the transmission wheel 160, and the driven end of the torque limiter 170 is fixedly connected to the first rotating shaft 123. When resistance received by the first rotating shaft 123 exceeds a rated load of the torque limiter 170, the driving end of the torque limiter 170 rotates idly and the driven end of the torque limiter 170 does not rotate, so that the transmission wheel 160 and the first rotating shaft 123 relatively slip, and the transmission connection between the transmission wheel 160 and the first rotating shaft 123 is disconnected.

The arrangement of the torque limiter 170 avoids, to a certain extent, shock and vibration caused to the motor 117 after the first passage plate 120 and the second passage plate 130 are rotated in place, thereby realizing overload protection of the motor 117, and extending a working life of the motor 117.

In an embodiment, the motor 117 and the second gear 150 are in transmission connection, and the torque limiter 170 is disposed between the motor 117 and the second gear 150.

With continuous reference to FIG. 2 and FIG. 5, in the present embodiment, the sheet-type medium conveying device 100 may further include a limiting member 113 to limit a rotation angle of the first passage plate 120 and a rotation angle of the second passage plate 130. That is, the limiting member 113 is configured to limit at least one of the following: a maximum rotation angle of the first passage plate 120; and a maximum rotation angle of the second passage plate 130. Such arrangement enables the first passage plate 120 and the second passage plate 130 to ensure a fixed rotation angle each time, thereby reducing guide failure caused by an excessive rotation angle of the first passage plate 120 and the second passage plate 130, and further improving working reliability of the sheet-type medium conveying device 100 in the present embodiment.

With continuous reference to FIG. 2 to FIG. 5, in an embodiment, the limiting member 113 may be plate-shaped, and the limiting member 113 is fixed on the mounting frame 110. In the present embodiment, the limiting member 113 includes a first limiting plate 111 and a second limiting plate 112 that are oppositely disposed. The first passage plate 120 and the second passage plate 130 are disposed between the first limiting plate 111 and the second limiting plate 112. The first limiting plate 111 is configured to limit the maximum rotation angle of the first passage plate 120, and the second limiting plate 112 is configured to limit the maximum rotation angle of the second passage plate 130.

When the sheet-type medium conveying device 100 is in operation, the first limiting plate 111 and the second limiting plate 112 can be used to realize limiting of the first passage plate 120 and the second passage plate 130 respectively, and the limiting is reliable.

An abutting member is further provided between the first passage plate 120 and the second passage plate 130 for abutting when the first passage plate 120 and the second passage plate 130 rotate, so as to limit a minimum spacing between the first passage plate 120 and the second passage plate 130. In an embodiment, one side of the first passage plate 120 facing toward the second passage plate 130 is provided with a first limiting portion 122. The abutting member provided between the first passage plate 120 and the second passage plate 130 includes the first limiting portion 122 to limit the minimum spacing between the first passage plate 120 and the second passage plate 130.

In an embodiment, one side of the second passage plate 130 facing toward the first passage plate 120 is provided with a second limiting portion 132. The abutting member provided between the first passage plate 120 and the second passage plate 130 includes the second limiting portion 132 to limit the minimum spacing between the first passage plate 120 and the second passage plate 130.

In an embodiment, one side of the first passage plate 120 facing toward the second passage plate 130 is provided with a first limiting portion 122, and one side of the second passage plate 130 facing toward the first passage plate 120 is provided with a second limiting portion 132. The abutting member provided between the first passage plate 120 and the second passage plate 130 includes the first limiting portion 122 and the second limiting portion 132 to limit the minimum spacing between the first passage plate 120 and the second passage plate 130.

In an embodiment, as shown in FIG. 2 to FIG. 5, the first end 124 and the second end 125 of the first passage plate 120 each are provided with a first limiting portion 122. The first end 134 and the second end 135 of the second passage plate 130 each are provided with a second limiting portion 132. The first passage plate 120 and the second passage plate 130 abut against with each other via the first limiting portion 122 and the second limiting portion 132 so as to limit the minimum spacing between the first passage plate 120 and the second passage plate 130, that is, a minimum width of the narrow opening.

As shown in FIG. 4, in the banknote outputting process, the first passage plate 120 and the second passage plate 130 rotate until the first limiting portion 122 located at the first end of the first passage plate 120 and the second limiting portion 132 located at the first end of the second passage plate 130 are abutted against each other. At this moment, a flared passage is formed between the first passage plate 120 and the second passage plate 130 and configured for the banknotes to pass through. As shown in FIG. 5, in the banknote inputting process, the first passage plate 120 and the second passage plate 130 rotate until the first limiting portion 122 located at the second end of the first passage plate 120 and the second limiting portion 132 located at the second end of the second passage plate 130 are abutted against each other, and an inverted flared passage is formed between the first passage plate 120 and the second passage plate 130 and configured for the banknotes to pass through.

In an embodiment, along a direction perpendicular to the banknote conveying direction, both ends of the first passage plate 120 are provided with the first limiting portion 122, and both ends of the second passage plate 130 are provided with the second limiting portion 132. Such arrangement avoids, to a certain extent, excessive narrowing of the passage 40 caused by changes in flexible deformation of the first passage plate 120 and the second passage plate 130, ensuring reliability of the banknote inputting and outputting, thereby improving working reliability of the sheet-type medium conveying device 100 of the present embodiment.

In an embodiment, the first passage plate 120 and the second passage plate 130 are, but not limited to, respectively provided with the limiting portions (i.e., the first limiting portion 122 and the second limiting portion 132), other arrangements may also be adopted; for example, a limiting portion (i.e., the first limiting portion 122 or the second limiting portion 132) is provided on one of first passage plate 120 and the second passage plate 130; that is, as long as the rotation angle of the first passage plate 120 and the rotation angle of the second passage plate 130 can be limited, and after the first passage plate 120 and the second passage plate 130 are rotated in place, a passage 40 suitable for the banknotes to pass through is formed to ensure smooth banknote inputting and outputting through this arrangement.

With continuous reference to FIG. 2 to FIG. 5, in the present embodiment, abutting surfaces of the first limiting portion 122 and the second limiting portion 132 may be arc-shaped. Such arrangement avoids stress concentration to a certain extent, thereby reducing impact damage caused to the first limiting portion 122 and the second limiting portion 132 during a contact process between the first limiting portion 122 and the second limiting portion 132, and extending a working life of the first limiting portion 122 and a working life of the second limiting portion 132. Therefore, reliability of the limiting is ensured.

With continuous reference to FIG. 2, FIG. 4, and FIG. 5, in an embodiment, the sheet-type medium conveying device 100 may further include a detection assembly 180 configured to detect whether or not banknotes exist between the first passage plate 120 and the second passage plate 130. By providing the detection assembly 180, the staff can know in time whether or not banknotes exist between the first passage plate 120 and the second passage plate 130. Therefore, to a certain extent, the phenomenon of banknote tearing caused by pulling the upper device 10 out of the cash recycling and handling apparatus and the cash box 210 from the safe 200 is avoided, and the loss caused by the banknote tearing is reduced or even avoided.

With continuous reference to FIG. 4 and FIG. 5, in an embodiment, the detection assembly 180 includes a signal transmitter 181 mounted on the first limiting plate 111 and a signal receiver 182 mounted on the second limiting plate 112. In an embodiment, the first passage plate 120 and the second passage plate 130 each are provided with a through hole, so that the signal receiver 182 is capable of receiving signals from the signal transmitter 181.

When the detection assembly 180 is in operation, the signal transmitter 181 transmits a signal to the signal receiver 182. If banknotes exist between the first passage plate 120 and the second passage plate 130, the banknotes block the signal to transmit through, thus the signal receiver 182 cannot receive the signal. Then the detection assembly 180 outputs a first detection signal to a controller, and the controller thus determines that banknotes exist between the first passage plate 120 and the second passage plate 130. Conversely, if no banknote exists between the first passage plate 120 and the second passage plate 130, the signal receiver 182 receives a signal from the signal transmitter 181, and then the detection assembly 180 outputs a second detection signal to the controller, and the controller thus determines that no banknote exists between the first passage plate 120 and the second passage plate 130. Subsequently, the controller controls the alarm to send out prompt information, so as to achieve the purpose of reminding an operator.

In order to ensure reliability of detection, in the present embodiment, two groups of detection assemblies 180 may be provided, and the two groups of detection assemblies 180 are arranged at an interval along a width direction of the passage 40, as shown in FIG. 2. Such arrangement reduces an error in a detection process, thereby further improving the working reliability of the cash recycling and handling apparatus of the present embodiment.

In the present embodiment, by providing the above-mentioned sheet-type medium conveying device 100 in the cash recycling and handling apparatus, guidance of the banknotes between the public conveying passage 700 and at least one cash box 210 is realized, thereby ensuring smooth running of banknote inputting and outputting, which, to a certain extent, avoids failure of the cash recycling and handling apparatus caused by the difficulty in banknote inputting and outputting, and improves the working reliability of the cash recycling and handling apparatus.

In an embodiment, the upper device 10 may further include a temporary storage device 500.

In an embodiment, the at least one sheet-type medium conveying device 100 is mounted on a top wall of the safe 200. In an embodiment, a gap is provided between at the least one sheet-type medium conveying device 100 and the upper device 10, and another gap is provided between the at least one sheet-type medium conveying device 100 and a corresponding cash box 210, and the above-mentioned gaps each can at least accommodate a single banknote to pass through.

The gap is provided between the sheet-type medium conveying device 100 and the upper device 10, and the another gap is provided between the sheet-type medium conveying device 100 and a corresponding cash box 210, so that banknotes jammed between the first passage plate 120 and the second passage plate 130 can be bent in the corresponding gap when the upper device 10 is pulled out or the cash box 210 is pulled out of the safe 200, without tearing the banknote, and to a certain extent, avoiding damage of the banknote. In addition, the cash recycling and handling apparatus has a simple structure, a short development period, and high market economic value.

With continuous reference to FIG. 1, FIG. 2, FIG. 4, and FIG. 5, in an embodiment, both ends of the first passage plate 120 are provided with a plurality of first slots 121, and both ends of the second passage plate 130 are provided with a plurality of second slots 131.

During rotation of the first passage plate 120 and the second passage plate 130, the plurality of first slots 121 and the plurality of second slots 131 are configured for a passage plate of the public conveying passage 700 to insert into and fit with or for a passage plate of a cash box 210 to insert into and fit with, so that a closed passage is formed between the public conveying passage 700 and the respective cash box 210.

The first passage plate 120 and the second passage plate 130 utilize the first slots 121 and the second slots 131 for other passage plates in the cash recycling and handling apparatus to insert into and fit with, so that the first passage plate 120 and an adjacent passage plate can always maintain a connected state and the second passage plate 130 and an adjacent passage plate can always maintain a connected state during the rotation of the first passage plate 120 and the second passage plate 130 to guide the banknotes. As a result, a conveying process of the banknotes is completed in a closed passage, which, to a certain extent, avoids the phenomenon of banknotes jamming in the gap between the first passage plate 120 and the adjacent passage plate or the gap between the second passage plate 130 and the adjacent passage plate. Therefore, the transmission reliability is guaranteed, and the working reliability of the cash recycling and handling apparatus is greatly improved in the present embodiment.

FIG. 4 and FIG. 5 merely show that the upper of the first passage plate 120 is provided with the first slots 121 and the upper end of the second passage plate 130 is provided with the second slots 131. In practice, the positions of the first slots on the first passage plate 120 and the second slots on the second passage plate 130 can be set according to positions of other passage plates in the cash recycling and handling apparatus. In one example, the first slots 121 are provided at both the upper and lower ends of the first passage plate 120 and the second slots 131 are provided at both the upper and lower ends of the second passage plate 130. In another example, the first slots 121 are provided merely at the lower end of the first passage plate 120 and the second slots 131 are provided merely at the lower end of the second passage plate 130, that is, as long as the inserting connection manner between the first passage plate 120 and the adjacent passage plate thereof and between the second passage plate 130 and the adjacent passage plate thereof can ensure that the closed passage is formed between the public conveying passage 700 and the cash box 210.

The basic operation process of the cash recycling and handling apparatus is described as follows. In the banknote inputting process, the banknotes are entered from the input device 300, after being identified by the banknote identification device 600, banknotes that meet requirements are conveyed by the public conveying passage 700 and stored in a recycling box of at least one cash box 210 of the safe 200, while unqualified banknotes are conveyed to the temporary storage device 500. In the banknote outputting process, banknotes are entered into the public conveying passage 700 from the cash box 210, and conveyed by the public conveying passage 700, and then banknotes that meet requirements are output through the output device 400.

The sheet-type medium conveying device 100 provided by the present embodiment realizes expansion of the conveying passage by using the wide opening between the first passage plate 120 and the second passage plate 130, so that the banknotes can smoothly enter the passage 40 formed by the first passage plate 120 and the second passage plate 130, and then get output. At the same time, the sheet-type medium conveying device 100 realizes guidance of the sheet-type medium by using the narrow opening between the first passage plate 120 and the second passage plate 130. The narrow opening is docked to the target passage to ensure that the sheet-type medium can be reliably guided into the target passage, thereby ensuring smooth bidirectional conveying of the sheet-type medium. In addition, the sheet-type medium conveying device is simple in structure and easy in implementation, which is of great significance for guidance and conveying of banknotes in financial self-service apparatus.

By providing the above-mentioned sheet-type medium conveying device 100 in the cash recycling and handling apparatus, guidance of bidirectional movement of the banknotes between the public conveying passage 700 and the cash box 210 is realized, thereby ensuring smooth running of banknote inputting and outputting, which, to a certain extent, avoids failure of the cash recycling and handling apparatus caused by the difficulty in banknote inputting and outputting, and improves the working reliability of the cash recycling and handling apparatus.

What is claimed is:

1. A sheet-type medium conveying device, comprising: a first passage plate, a second passage plate and a driving mechanism, wherein the first passage plate and the second passage plate are oppositely arranged, a passage is formed between the first passage plate and the second passage plate, and configured for a sheet-type medium to pass through; and the driving mechanism is configured to drive a first end of the first passage plate and a first end of the second passage plate to get close to or away from each other;

wherein the sheet-type medium is capable of moving bidirectionally in the passage;

the driving mechanism is configured to drive the first passage plate and the second passage plate to rotate in response to the sheet-type medium moving in a first direction in the passage, so that the first end of the first passage plate and the first end of the second passage plate get close to each other, a second end of the first passage plate and a second end of the second passage plate get away from each other, a narrow opening is formed between the first end of the first passage plate and the first end of the second passage plate, and a wide opening is formed between the second end of the first passage plate and the second end of the second passage plate; and the driving mechanism is configured to drive the first passage plate and the second passage plate to rotate in response to the sheet-type medium moving in a second direction opposite to the first direction in the passage, so that the first end of the first passage plate and the first end of the second passage plate get away from each other, the second end of the first passage plate and the second end of the second passage plate get close to each other, a wide opening is formed between the first end of the first passage plate and the first end of the second passage plate, and a narrow opening is formed between the second end of the first passage plate and the second end of the second passage plate.

2. The sheet-type medium conveying device according to claim 1, further comprising a mounting frame, wherein the first passage plate and the second passage plate are both pivotally connected to the mounting frame.

3. The sheet-type medium conveying device according to claim 2, wherein the driving mechanism comprises a motor, a first gear, and a second gear, wherein the first passage plate is pivotally connected to the mounting frame via a first rotating shaft, and the first gear is fixedly sleeved onto the first rotating shaft; the second passage plate is pivotally connected to the mounting frame via a second rotating shaft, the second gear is fixedly sleeved onto the second rotating shaft, the first gear is in meshing connection with the second gear, and the motor is in transmission connection with the first gear or the second gear.

4. The sheet-type medium conveying device according to claim 3, wherein in a case where the motor is transmission connection with the first gear, a torque limiter is provided between the motor and the first gear; and in a case where the motor is in transmission connection with the second gear, the torque limiter is provided between the motor and the second gear.

5. The sheet-type medium conveying device according to claim 1, further comprising a limiting member configured to limit at least one of the following: a maximum rotation angle of the first passage plate, and a maximum rotation angle of the second passage plate.

6. The sheet-type medium conveying device according to claim 1, wherein one side of the first passage plate facing toward the second passage plate is provided with a first limiting portion to limit a minimum spacing between the first passage plate and the second passage plate.

7. The sheet-type medium conveying device according to claim 1, wherein one side of the second passage plate facing toward the first passage plate is provided with a second limiting portion to limit a minimum spacing between the first passage plate and the second passage plate.

8. The device according to claim 1, further comprising a detection assembly configured to detect whether or not the sheet-type medium exists between the first passage plate and the second passage plate.

9. A cash recycling and handling apparatus, comprising an upper device and a lower device;

wherein a public conveying passage is provided in the upper device;

the lower device comprises a safe and a plurality of cash boxes located in the safe, a branch passage is provided between the public conveying passage and each of the plurality of cash boxes, and at least one of a plurality of branch passages between the public conveying passage and the plurality of cash boxes is a sheet-type medium conveying device, wherein the sheet-type medium conveying device, comprising: a first passage plate, a second passage plate and a driving mechanism, wherein the first passage plate and the second passage plate are oppositely arranged, a passage is formed between the first passage plate and the second passage plate, and configured for a sheet-type medium to pass through; and the driving mechanism is configured to drive a first end of the first passage plate and a first end of the second passage plate to get close to or away from each other;

wherein the sheet-type medium is capable of moving bidirectionally in the passage;

the driving mechanism is configured to drive the first passage plate and the second passage plate to rotate in response to the sheet-type medium moving in a first direction in the passage, so that the first end of the first passage plate and the first end of the second passage plate get close to each other, a second end of the first passage plate and a second end of the second passage plate get away from each other, a narrow opening is formed between the first end of the first passage plate and the first end of the second passage plate, and a wide opening is formed between the second end of the first passage plate and the second end of the second passage plate; and the driving mechanism is configured to drive the first passage plate and the second passage plate to rotate in response to the sheet-type medium moving in a second direction opposite to the first direction in the passage, so that the first end of the first passage plate and the first end of the second passage plate get away from each other, the second end of the first passage plate and the second end of the second passage plate get close to each other, a wide opening is formed between the first end of the first passage plate and the first end of the second passage plate, and a narrow opening is formed between the second end of the first passage plate and the second end of the second passage plate.

10. The cash recycling and handling apparatus according to claim 9, wherein both ends of the first passage plate of the sheet-type medium conveying device are provided with a plurality of first slots, both ends of the second passage plate are provided with a plurality of second slots, and during the first passage plate and the second passage plate rotating, the plurality of first slots and the plurality of second slots are configured for a passage plate of the public conveying passage to insert into and fit with or for a passage plate of a respective cash box to insert into and fit with, so that a closed passage is formed between the public conveying passage and the respective cash box.

11. The cash recycling and handling apparatus according to claim 9, wherein the sheet-type medium conveying device is mounted on a top wall of the safe.

12. The sheet-type medium conveying device according to claim 6, wherein one side of the second passage plate facing toward the first passage plate is provided with a second limiting portion to limit a minimum spacing between the first passage plate and the second passage plate.

13. The cash recycling and handling apparatus according to claim 9, wherein the sheet-type medium conveying device further comprises a mounting frame, wherein the first passage plate and the second passage plate are both pivotally connected to the mounting frame.

14. The cash recycling and handling apparatus according to claim 13, wherein the driving mechanism comprises a motor, a first gear, and a second gear, wherein the first passage plate is pivotally connected to the mounting frame via a first rotating shaft, and the first gear is fixedly sleeved onto the first rotating shaft; the second passage plate is pivotally connected to the mounting frame via a second rotating shaft, the second gear is fixedly sleeved onto the second rotating shaft, the first gear is in meshing connection with the second gear, and the motor is in transmission connection with the first gear or the second gear.

15. The cash recycling and handling apparatus according to claim 14, wherein in a case where the motor is transmission connection with the first gear, a torque limiter is provided between the motor and the first gear; and in a case where the motor is in transmission connection with the second gear, the torque limiter is provided between the motor and the second gear.

16. The cash recycling and handling apparatus according to claim 9, wherein the sheet-type medium conveying device further comprises a limiting member configured to limit at least one of the following: a maximum rotation angle of the first passage plate, and a maximum rotation angle of the second passage plate.

17. The cash recycling and handling apparatus according to claim 9, wherein one side of the first passage plate facing toward the second passage plate is provided with a first limiting portion to limit a minimum spacing between the first passage plate and the second passage plate.

18. The cash recycling and handling apparatus according to claim 9, wherein one side of the second passage plate facing toward the first passage plate is provided with a second limiting portion to limit a minimum spacing between the first passage plate and the second passage plate.

19. The cash recycling and handling apparatus according to claim 9, wherein the sheet-type medium conveying device further comprises a detection assembly configured to detect whether or not the sheet-type medium exists between the first passage plate and the second passage plate.

* * * * *